US005606620A

United States Patent [19]

Weinfurtner

[11] Patent Number: 5,606,620

[45] Date of Patent: Feb. 25, 1997

[54] DEVICE FOR THE ADAPTATION OF PROGRAMMABLE HEARING AIDS

[75] Inventor: Oliver Weinfurtner, Erlangen, Germany

[73] Assignee: Siemens Audiologische Technik GmbH, Erlangen, Germany

[21] Appl. No.: 393,825

[22] Filed: Feb. 24, 1995

[30] Foreign Application Priority Data

Mar. 23, 1994 [EP] European Pat. Off. ..... 94104617

[51] Int. Cl.[6] ..... H04R 25/00

[52] U.S. Cl. ..... 381/68.2; 381/58; 381/60; 381/68.4

[58] Field of Search ..... 381/58, 68, 68.2, 381/68.4, 60, 86, 94, 98, 103, 106, 107; 73/585; 128/746; 395/2.34, 2.35, 3, 61, 900

[56] References Cited

U.S. PATENT DOCUMENTS 5,144,674 9/1992 Meyer et al. ..... 381/68

FOREIGN PATENT DOCUMENTS 0398536 11/1990 European Pat. Off. .
0573845 12/1993 European Pat. Off. .
4225758 2/1994 Germany .
671131 7/1989 Switzerland .

*Primary Examiner*—Curtis Kuntz
*Assistant Examiner*—Huyen D. Le
*Attorney, Agent, or Firm*—Hill, Steadman & Simpson

[57] ABSTRACT

An adaptation device employing a fuzzy logic system enables an optimum adaptation of programmable hearing aids according to the individual, audiometric data of the hearing impairment with a meaningfully adapted setting of the hearing aid parameters taking rules predetermined and tested by the hearing aid manufacturer into consideration, while also considering the characteristic data associated with the hearing aid. The adaptation device is a data processing unit with a fuzzy logic module whose arithmetic unit processes the hearing impairment data and the characteristic data, which can be entered and/or retrieved from a storage unit, according to the principles of fuzzy logic, and using processing rules from at least one rule storage unit.

8 Claims, 4 Drawing Sheets

DEVICE FOR THE ADAPTATION OF PROGRAMMABLE HEARING AIDS

BACKGROUND OF THE INVENTION

1. Field of the Invention

The present invention is directed to a device for communicating with a programmable hearing aid for adapting the programmable hearing aid by providing operating parameters to the programmable hearing aid to set the hearing aid for operation matched to the hearing impairment of the user and/or various auditory situations.

2. Description of the Prior Art

It is known for manufacturers to provide characteristic data to a hearing acoustician to enable the acoustician to enter operating parameters into the hearing aid for setting the hearing aid, so that the hearing aid operates in a manner which is intended to be matched to the particular impairment of the user, and/or to particular auditory situations, such as a loud or noisy environment, use with a telephone, etc.

Programmable hearing aids of this type offer a number of adjustable parameters which are intended to enable the optimum matching of the electro-acoustic behavior of the hearing aid to the hearing impairment to be compensated. At the same time, however, the adaptation becomes increasingly difficult for the hearing aid acoustician because of the number of parameters and the multitude of possible setting combinations arising therefrom. This can lead to a faulty adaptation of the hearing aid or to a non-optimum utilization of all adaptation possibilities.

SUMMARY OF THE INVENTION

It is an object of the present invention to provide a device for adapting (i.e., setting operating parameters for) of programmable hearing aids that enables an optimum adaptation of the hearing aid to the hearing loss to be compensated, and which enables the adaptation to be implemented in a simple way, and whereby all adaptation possibilities associated with the hearing aid can be optimally utilized taking rules prescribable by the hearing aid manufacturer into consideration.

In a device of the type initially described, this object is inventively achieved in a data processing unit which includes a fuzzy logic module whose arithmetic unit processes the data and characteristics that can be entered and/or retrieved from a memory. The processing is undertaken using fuzzy logic operating on processing rules specified by the hearing aid manufacturers and stored in at least one rule memory. Setting data for the hearing aid are obtained as a result.

The hearing aid acoustician can be provided with a programming unit realized according to the principles of fuzzy logic and, after entering the audiometric data as well as of the type of the hearing aid to be adapted, the programming unit proposes optimum settings of all hearing aid parameters that are meaningfully matched to one another. These setting proposals can be completely accepted by the hearing aid acoustician, or can be modified as needed after further acoustic measurements.

The fuzzy logic module, or the complete data processing unit, is supplied, for example, by the manufacturer of the hearing aid. The control unit of the module can be expanded by the user of the adaptation device to enter further processing rules for calculating the hearing aid parameters into a data carrier of the module, these processing rules being based on special empirical values developed according to the experience of the acoustician.

DESCRIPTION OF THE PREFERRED EMBODIMENTS

Figure 1:
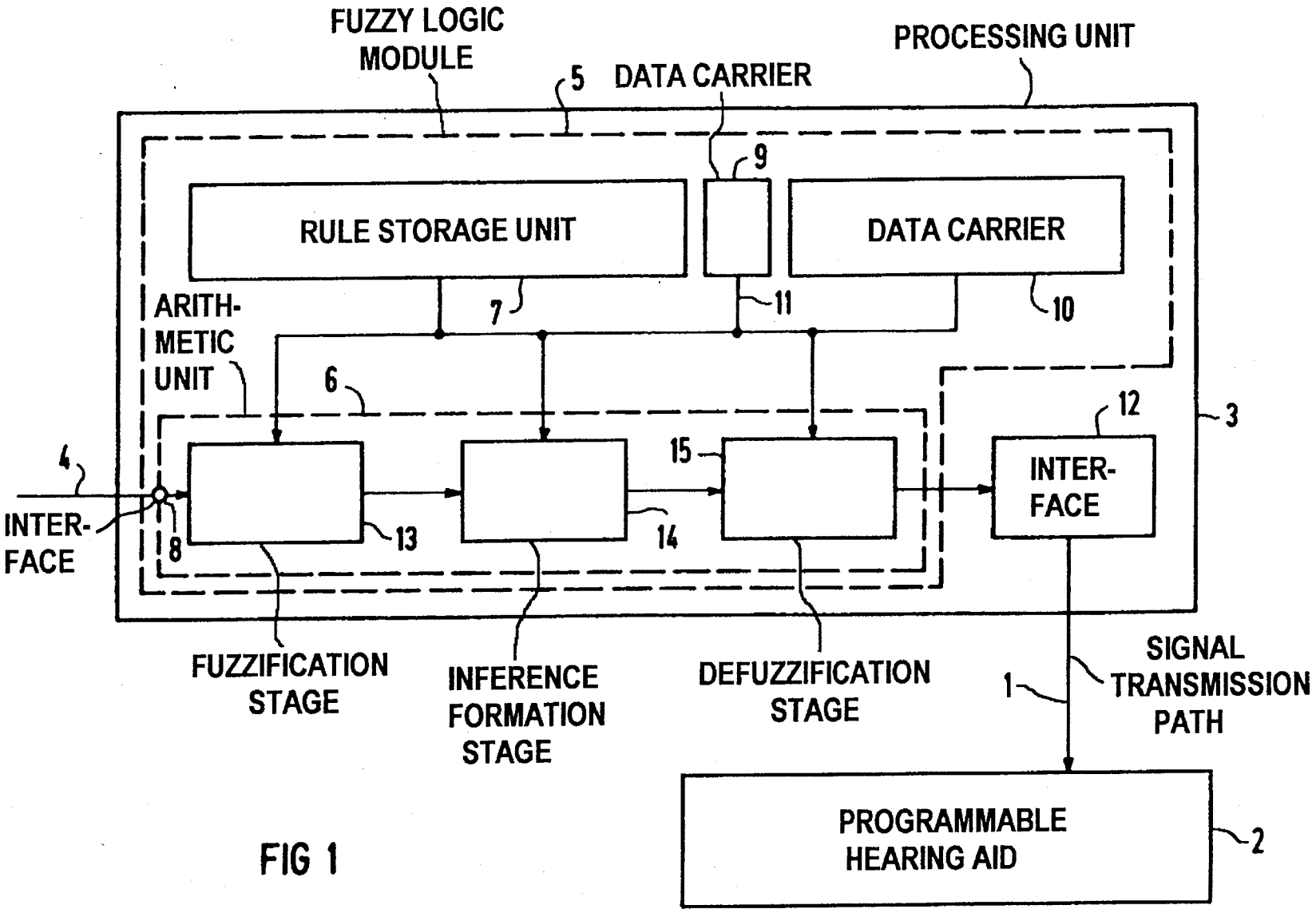
FIG. 1 is a block circuit diagram of a device constructed in accordance with the principles of the present invention for the adaptation of programmable hearing aids.

The inventive device schematically shown in FIG. 1 for the realization of a fuzzy logic system for identifying the adaptation parameters for a programmable hearing aid 2 can be implemented in the form of an independent programming device or can be implemented in combination with a personal computer or in combination with some other data processing system. The device is in the form of a data processing unit 3 that can be coupled to the hearing aid 2 via an interface 12 to a signal transmission path 1. The signal transmission can ensue via a line connection or wirelessly. The data processing unit 3 forming the programming device external of the hearing aid 2 includes a fuzzy logic module 5. This module 5 in turn contains an arithmetic unit 6 or a processor having components for the implementation of the fuzzy logic operations: a fuzzification stage 13, an inference formation stage 14 and a defuzzification stage 15. Further, the fuzzy logic module 5 contains at least one rule storage unit, which may be a semiconductor memory such as an EEPROM, or a data carrier such as a diskette. Processing rules for calculating setting data for the hearing aid are stored in fetchable fashion in this rule storage unit 7. The data 4 characterizing the respective hearing loss of the hearing aid wearer and the characteristic data 11 prescribed by the hearing aid manufacturer for the hearing aid 2 to be programmed can be involved in the determination or calculation of the setting data for the hearing aid and/or the hearing aid parameters. The entry of the data 4 describing the hearing loss of the hearing-impaired person ensues via an interface 8 into the arithmetic unit 6 of the data processing unit 3 or, more specifically, of the fuzzy logic module 5. A data carrier 9 for the characteristic data 11 associated with the hearing aid is also allocated to the data processing unit 3 (i.e., to the fuzzy logic module 5). The characteristic data 11 in the data carrier 9 associated with the hearing aid and prescribed by the hearing aid manufacturer are supplied to the arithmetic unit 6 or can be retrieved by the arithmetic unit 6.

In the illustrated exemplary embodiment, a further rule storage unit of the hearing aid acoustician is provided in addition to the rule storage unit 7 in which the processing rules of the hearing aid manufacturer are stored and fetchable. The data carrier 10 of said further rule storage unit provides the hearing aid acoustician with the possibility of additionally storing processing rules that derive from his or her own empirical knowledge. The acoustician undertaking the adaptation of the hearing aid can thereby determine the processing rules to be entered into the data carrier 10, and can repeatedly modify or correct them, whereby the processing rules of the rule storage unit 7 prescribed by the manufacturer should be invariable.

Advantages of the invention are as follows.

In the adaptation of a programmable hearing aid, hearing aid acousticians were previously capable of only either accepting the standard settings for programmable hearing aids, or for the individual auditory situations prescribed by the factory; or individually setting/modifying each parameter of the hearing aid or of the particular auditory situation.

A disadvantage of this procedure is that, in the former instance, the individual adaptation possibilities of the programmable hearing aid can not be exploited at all or, in the latter instance, a setting of the hearing aid parameters occurs that possibly may not be optimum or even false despite a high adaptation outlay.

The adaptation means of the invention based on the principles of fuzzy logic is particularly distinguished in comparison to the above conventional procedure by the following advantages:

The optimum setting of all hearing aid parameters meaningfully matched to one another in accord with the individual, audiometric data of the hearing impairment is possible according to universally valid rules that are prescribed and checked by the hearing aid manufacturer.

The setting of all parameters of a programmable hearing aid is a complex optimization procedure that can not always be solved in a closed, predetermined format. On the contrary, individual rules acquired from experience play an important part therein. In many configurations of the input data and/or sets or rules, demands that partially contradict one another can arise for the setting of individual parameters. The processing of such partly contradictory sub-results for the purpose of an overall optimum is an inherent capability of fuzzy logic.

The audiometric data calculated in the adaptation practice are generally affected with relatively large tolerances. An adaptation mechanism that works according to the principle of fuzzy logic, however, is inherently extremely resistant to such tolerances due to the fuzzification of the input data, i.e. the fact that the input data may be imprecise does not lead to a loss of accuracy of the calculated parameter set for the programming of the hearing aid, or leads to only a slight loss of accuracy.

Figure 2:
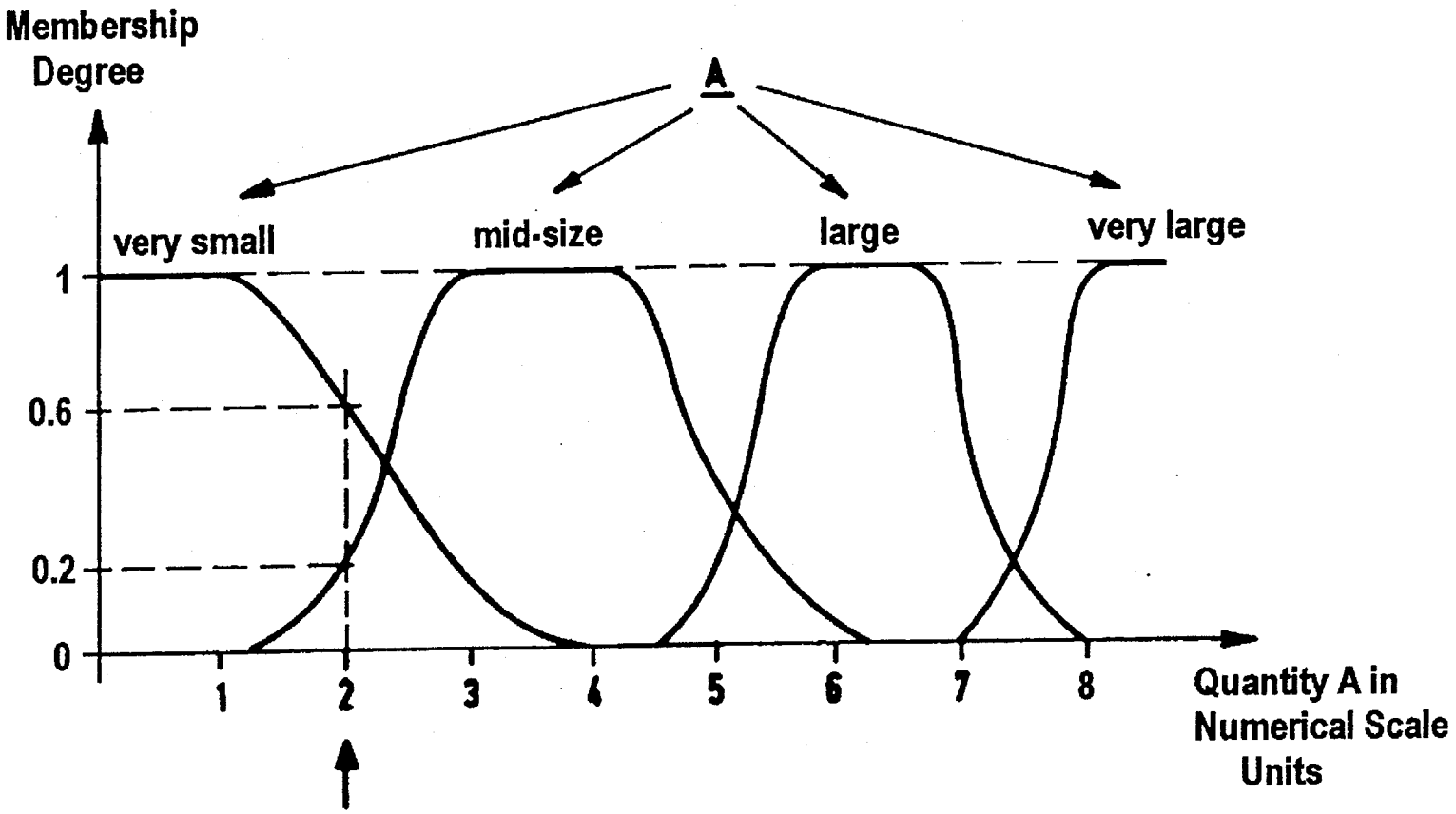
FIGS. 2–4 are exemplary illustrations of the fundamental principle for the employment of fuzzy logic in the calculation of adaptation parameters of a programmable hearing aid in accordance with the principles of the present invention..

An exemplary explanation of the application of fuzzy logic in the calculation of adaptation parameters of a programmable hearing aid shall be set forth below with reference to FIGS. 2–4, wherein the processing of quantities with fuzzy logic is shown.

The first step for the implementation of a fuzzy logic operation according to the example is the definition of the linguistic variables for the input and output quantities. For each of these quantities, the terms thereof are entered relative to a numerical value scale. The variable quantity A is shown in units defined by a numerical value scale on the x-axis of the coordinate system. The degree of membership is shown on the y-axis. The "crisp" value A=2 on the numerical value scale, for example, thus is a member of the linguistic term "A is very small" with a degree of 0.6 and is a member of the linguistic term "A is mid-size" with a degree of 0.2

After this fuzzification, the sharp value A=2 is described with the following set of statements as fuzzy value (linguistic variable) A:

μ (A is very small)=0.6;

μ (A is mid-size)=0.2;

μ (A is large)=0.0;

μ (A is very large)=0.0.

μ is thus the "degree of satisfaction" or "degree of truth" of the respective statement.

The further processing of the quantities in the fuzzy logic system, particularly operation thereon according to the rules of the control unit (inference), then occurs using this fuzzified presentation.

The result of the overall exemplary operation is converted into crisp values at the output of the fuzzy logic system (defuzzification).

Figure 3:
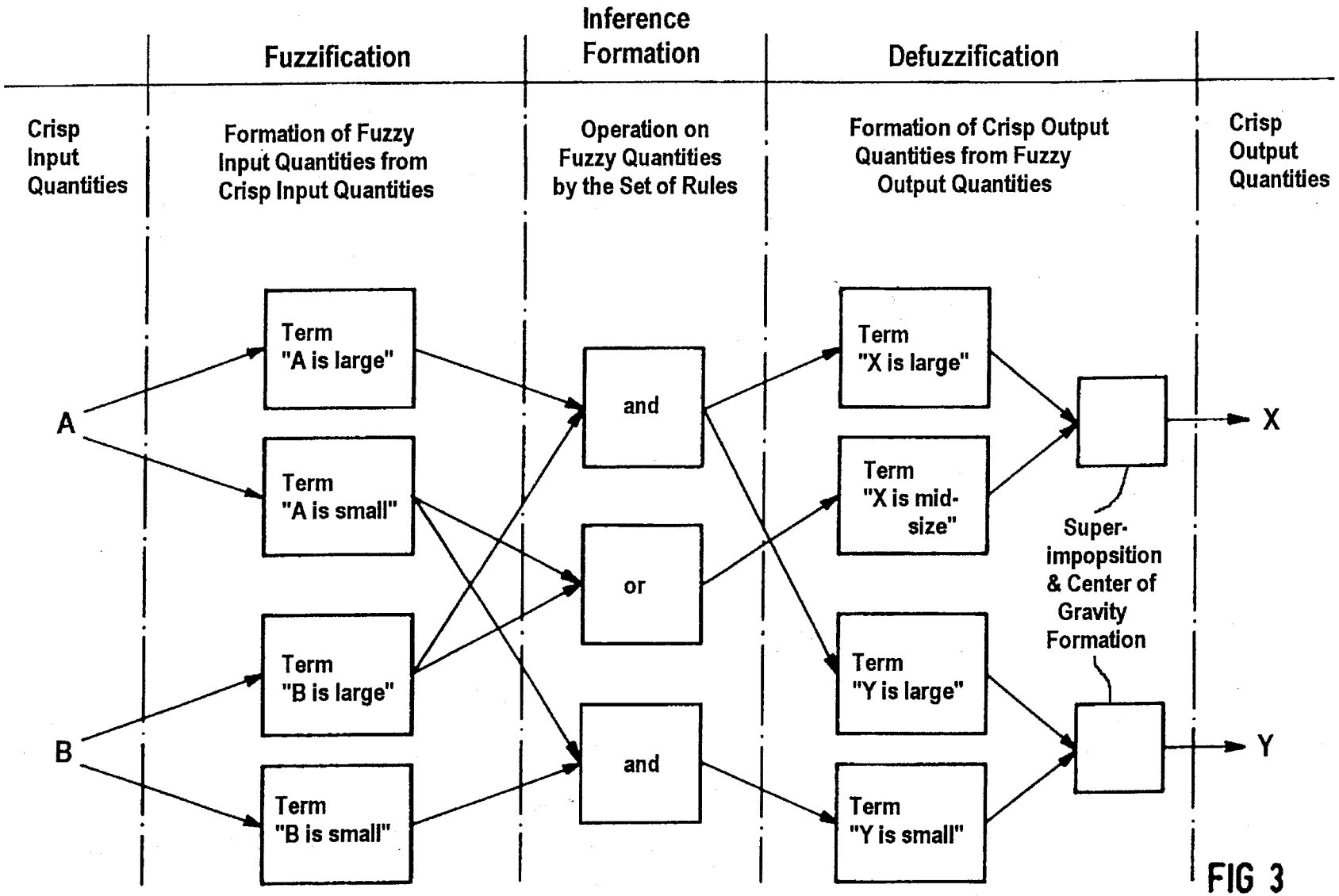

FIG. 3 shows an overview of the logical structure of a fuzzy logic system that operates according to the following, exemplary set of rules:

Rule 1: if A is large and B is large then X is large and Y is large.

Rule 2: if A is small or B is large then X is mid-size.

Rule 3: if A is small and B is small then Y is small.

Figure 4:
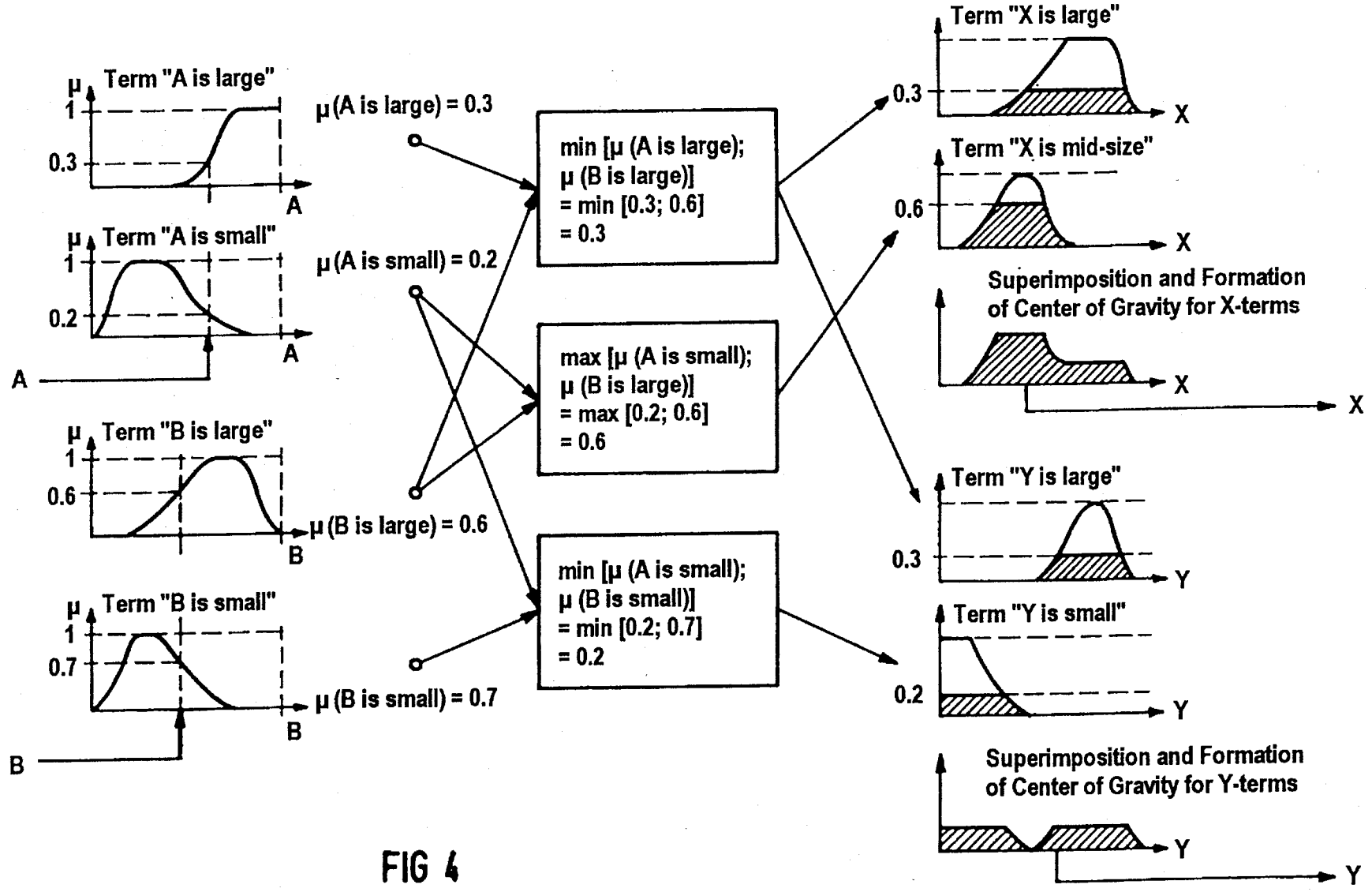

FIG. 4 illustrates the functioning of this fuzzy logic system in graphic form:

The two crisp input quantities A and B are fuzzified in the above-described way. The two operators and or in this example are realized in the standard way as minimum and maximum formation. Other types of realization generally known from the literature may alternatively be used. The degrees of satisfaction of the exemplary operations activate the terms of the fuzzy output quantities to the respective degrees. By superimposing the activated terms of each output quantity and the forming the center of gravity of its area, the crisp output quantities of the fuzzy logic system then arise. Known methods can be employed for the realization of this last step (defuzzification).

An exemplary embodiment of a fuzzy logic system for calculating adaptation parameters of a programmable, multichannel hearing aid can be constructed as follows:

Among others, the following characteristic quantities may serve as input quantities for the fuzzy logic system for calculating adaptation parameters:

hearing threshold at different frequencies discomfort threshold at various frequencies results of speech comprehension tests with/without disturbing noises subjective auditory impression of the hearing-impaired person by means of better/poorer evaluation of controlled comparison auditory conditions.

The following quantities, for example, may serve as output quantities of a fuzzy logic system for calculating adaptation parameters:

separating frequencies between a number of individual channels gain or gains

AGC threshold or thresholds; threshold or thresholds of the automatically operating gain control circuit or circuits AGC compression factor or factors peak clipping threshold or thresholds of limiting devices filter characteristics (corner frequency, slope)

maximum gain.

The exemplary control unit set forth below proceeds on the assumption that a discomfort threshold US and the hearing threshold HS of the patient have been identified at different frequencies (i.e., "US#1350" stands for discomfort threshold at 1350 Hz). The set of rules for the identification of the lower separating frequency UTF could, for example, be:

1. if (US#1350—US#350) is small then UTF is approximately 700 Hz.

2. if (US#1350—US#350) is large and (US#1350—US#700) is large then UTF is above 700 Hz.

3. if (US#1350—US#350) is large and (US#1350—US#700) is small then UTF is less than 700 Hz.

The set of rules for the calculation of the upper separating frequency (OTF) could, analogously, be:

1. if (US#2650—US#1350) is small then OTF is approximately 200 Hz.

2. if (US#2650—US#1350) is large and (US#2650—US#2000) is large then OTF is higher than 2000 Hz.

3. if (US#2650—US#1350) is large and (US#2650—US#2000) is small then OTF is below 2000 Hz.

The rules for the determination of the AGC threshold in the lower channel AGCU could be defined as follows:

1. if (US#350) is low then AGCU is low.

2. if (US#350) is high then AGCU is high.

The set of rules for the determination of the gain in the lower channel GU could be:

1. if (HS#350) is low then GU is mid-size.

2. if (HS#350) is high then GU is high.

One possibility of the set of rules for setting the peak clipping threshold PCS is:

1. if (US#350) or (US#1350) or (US#2650) is low then PCS is low.

2. if (US#350) and (US#1350) and (US#2650) is high then PCS is high.

Although modifications and changes may be suggested by those skilled in the art, it is the intention of the inventors to embody within the patent warranted hereon all changes and modifications as reasonably and properly come within the scope of their contribution to the art.

I claim as my invention:

1. A device for use with a programmable hearing aid for supplying operating parameters to the hearing aid to set the operation of the hearing aid, said device comprising:

data processing means for developing a set of operating parameters for a programmable hearing aid matched to at least one of a hearing impairment of a user of the hearing aid and selected auditory conditions;

means for entering data into said data processing means characterizing said hearing impairment;

means for entering data into said hearing aid which identify operating characteristics of said hearing aid;

fuzzy logic means contained in said data processing means for operating on said data characterizing the hearing impairment and the data identifying operating characteristics of the hearing aid using a set of processing rules and applying fuzzy logic for producing setting data for said programmable hearing aid; and means for establishing a signal transmission path from said data processing unit to said programmable hearing aid for supplying said setting data to said programmable hearing aid.

2. A device as claimed in claim 1 further comprising data carrier means, contained in said fuzzy logic means, for storing said processing rules, and wherein said fuzzy logic means further contain an inference forming stage connected to said data carrier means, and means for fetching said processing rules from said data carrier means for use by said inference forming stage.

3. A device as claimed in claim 2 wherein said data carrier means comprises a semiconductor memory.

4. A device as claimed in claim 3 wherein said semiconductor memory comprises an EEPROM.

5. A device as claimed in claim 2 wherein said data carrier means comprises a diskette.

6. A device as claimed in claim 1 wherein said means for entering said data identifying operating characteristics of said programmable hearing aid comprises data carrier means for storing said data identifying said operating characteristics, contained in said data processing means.

7. A device as claimed in claim 1 further comprising means for entering additional processing rules into said fuzzy logic means, and wherein said fuzzy logic means comprises means for operating on said data characterizing the hearing impairment and the data identifying operating characteristics of the hearing aid using said set of processing rules and said additional processing rules and applying fuzzy logic for producing said setting data.

8. A device as claimed in claim 1 wherein said fuzzy logic means comprises an arithmetic unit containing, in sequence, a fuzzification stage, an inference formation stage and a defuzzification stage for operating on said data characterizing the hearing impairment and the data identifying operating characteristics of said programmable hearing aid using said processing rules.

* * * * *